US006141828A

United States Patent [19]

Kuo

[11] Patent Number: 6,141,828

[45] Date of Patent: Nov. 7, 2000

[54] LOCKING DEVICE FOR A RETRACTABLE PULL-HANDLE SYSTEM

[75] Inventor: Chung Hsien Kuo, Taipei County, Taiwan

[73] Assignee: Chaw-Khong Co., Ltd, Taipei, Taiwan

[21] Appl. No.: 09/164,820

[22] Filed: Oct. 1, 1998

[51] Int. Cl.[7] ..... B65D 25/28

[52] U.S. Cl. ..... 16/113.1; 16/405

[58] Field of Search ..... 16/113.1, 405; 190/115

[56] References Cited

U.S. PATENT DOCUMENTS

| | | | |
|---|---|---|---|
| 5,581,846 | 12/1996 | Wang | 16/113.1 |
| 5,620,070 | 4/1997 | Wang | 16/113.1 |
| 5,628,088 | 5/1997 | Chen | 16/113.1 |
| 5,692,266 | 12/1997 | Tsai | 16/113.1 |
| 5,727,898 | 3/1998 | Lu | 16/113.1 |
| 5,806,143 | 9/1998 | Tsai | 16/405 |
| 5,836,052 | 11/1998 | Chou | 16/115 |
| 5,875,520 | 3/1999 | Chang | 16/405 |

*Primary Examiner*—Anthony Knight
*Assistant Examiner*—Alison K. Pickard
*Attorney, Agent, or Firm*—Tung & Associates

[57] ABSTRACT

A locking means for locking an inner tube to an outer tube by using a vertical sliding block and a horizontal sliding block which are intimately matched together so that a vertical motion of the vertical sliding block can be transformed into a horizontal motion of a locking pin for locking or unlocking the tubes is disclosed. The invention further discloses a retractable pull-handle system that contains such a locking mechanism for use on wheeled luggage cases. Inclined surfaces are provided on the vertical and the horizontal sliding blocks such that when they are intimately mated together in a lock housing, vertical movement of a pull cable can be converted to horizontal movement of a locking pin.

14 Claims, 9 Drawing Sheets

LOCKING DEVICE FOR A RETRACTABLE PULL-HANDLE SYSTEM

FIELD OF THE INVENTION

The present invention generally relates to a retractable pull-handle assembly for use on a wheeled luggage and more particularly, relates to a locking device for a retractable pull-handle system on a wheeled luggage that can be easily constructed and assembled at low cost.

BACKGROUND OF THE INVENTION

In recent years, wheeled luggage cases have been popularly used by travelers in various forms of transportation, specifically at airports. In designing a wheeled luggage case, a number of design criteria for the case must be satisfied. For instance, the rigidity of the structure of the case, the reliability of the wheels for extended use, and a convenient pull-handle that can be securely locked when stowed. A rigid construction of the luggage case allows for extended use in rough service environments, i.e., when the case is wheeled in the streets, in and out of buildings with stairs, and in and out of carriers such as airplanes or trains. A reliable wheel means is necessary so that the luggage can be pulled on a relatively smooth pavement with ease for a long service life. A reliable pull-handle system should be provided for convenient operation by users such that the handle may be easily stowed away when not in use.

The design of a reliable and convenient to use pull-handle system is particularly important in the design of a wheeled luggage. When the design is inadequate, the pull-handle system along with its locking means can easily fail and cause serious problems. For instance, when a wheeled luggage is laid down on a flat surface or being positioned in an upside-down manner, the locking means for the pull-handle system must function properly to prevent any accidental extension of the handle due to gravity. Any such accidental extension of the handle may cause serious damage to the luggage when it is transported on an automated conveyor belt used at airports. The design of a reliable and convenient to use locking mechanism for a pull-handle system is therefore an important aspect of the design of a wheeled luggage.

Efforts have been made by others to improve the pull-handle system for a wheeled luggage case. For instance, U.S. Pat. No. 5,526,908 discloses a retractable handle assembly which can be extended and folded without exerting a large force on the assembly. The assembly includes a hollow bracket mounted on a top plate of one of the half bodies of the case, a pair of lug portions each formed on one of the distal end portions of the bracket and each having a cavity inside, a pair of outer tubes each securely mounted between the lug portion and a bottom plate of the half body and each having a second cavity laterally defined therein for aligning with the first cavity, the pair of inner tubes each is slidably mounted on one of the outer tubes and each has a third cavity laterally defined therein for aligning with the second cavity, and a substantially U-shaped handle portion mounted on the bracket which has two free end portions each engaging the upper end of a corresponding inner tube. The assembly further includes a pressing member mounted in the hallow bracket including a knob extending from an opening of the bracket, and a biasing member mounted under the pressing member which includes a pair of stops each extending through the first cavity, the second cavity and the third cavity.

U.S. Pat. No. 5,499,426 discloses a handle device which includes a pair of storage tubes for mounting on the back of a wheeled suitcase, a seat frame, a handle member and a locking mechanism. The locking mechanism is provided in the receiving space of the seat frame which includes two projecting members and a biasing unit between the projecting members for biasing the members toward the storage tubes and for locking the handle member relative to the storage tubes when the two engaging holes are in alignment. The locking mechanism further includes a retracting unit for retracting the projecting members to release the handle member from the storage tubes.

U.S. Pat. No. 5,431,428 further discloses a carrying case which is equipped with a collapsible handle assembly stored inside the case. The handle assembly can be operated by a push button which allows the handle to collapse within the case, a lock mechanism for holding a first handle portion in an extended position relative to the second handle portion. The lock means includes a selectably releaseable handle-locking protrusion on one of the first and second handle portions which is movable in opposing directions and away from the other of the first and second handle portions into and out of engagement therewith.

U.S. Pat. No. 5,502,876 discloses a pull-handle of a luggage trunk which includes a pair of driving rods each having a wedge member disposed at the bottom end of the trunk and is in abutment with a spring biased locking seat which has an oblique cam surface. Each of the driving rod is housed in a hollow tube while the locking seat is in selective engagement with one of a plurality of spaced retaining slots disposed in a movable sleeve which accommodates each hollow tube.

Another locking mechanism that has been used in the industry is shown in FIGS. 1, 2 and 3. The locking mechanism 10 for mounting into an inner tube 12 of a wheeled luggage is shown in FIG. 1. A perspective view of the components and a cross-sectional view of the locking means 10 are shown in FIGS. 2 and 3, respectively. As shown in FIG. 1, the locking mechanism 10 includes a housing member 14 and a locking pin 16 for engaging an aperture 18 in the inner tube 12 when the locking mechanism 10 is slid into a cavity 20 of the inner tube 12. The housing member 14 is provided with a slot opening 22 at the top surface adapted for the mounting of a vertical sliding block 24. The vertical sliding block 24 is equipped with an aperture 26 at or near the top for connecting to a cable 28, and inclined slot opening 30 at the center portion of the sliding block 24, and a hook 32 at the distal end of the vertical sliding block 24. For connecting to the inclined slot opening 30 of the vertical sliding block 24, a horizontal sliding pin 34 is also provided. The horizontal sliding pin 34 has a slot opening 36 and an aperture 38 through the slot opening 36. The aperture 38 is provided for accepting a mounting pin 40 therethrough. To allow the operation of the vertical sliding block 24, a spring device 42 is provided at the bottom hook 32 of the vertical sliding block 24. The bottom end of the spring 42 is connected to a mounting site 44 provided at the bottom surface of the cavity 20 in the housing member 14.

A cross-sectional view of the locking mechanism is shown in FIG. 3 which can be used to illustrate the operation of the mechanism. The locking mechanism 10 can be first assembled together by installing the vertical sliding block 24 into the vertical sliding slot, or the inner tube cavity 20 through a top opening 22 in the housing members 46, 14. The horizontal sliding pin 34 is then inserted from the front opening 20 onto the vertical sliding block 24 with the slot opening 36 riding on the body of the vertical sliding block 24 and the mounting aperture 38 aligned with the slot opening 30. A special tool must be used for the installation of the mounting pin 40 into the aperture 38 on the horizontal pin 34 and through the slot opening 30 of the vertical sliding pin 24. It is a time and labor consuming process. The spring device 42 is then mounted through the opening 20 onto the hook 32 at one end and onto the mounting site 44 at the other end.

The locking mechanism 10 can be operated in the following manner. When the vertical sliding block 24 moves in a vertical motion in the vertical slot opening 20, the slot opening 30 on the vertical sliding block 24 interacts with the mounting pin 30 and causing a horizontal movement of the horizontal sliding pin 16 in the horizontal slot opening 18. The function of the spring device 42 is to pull the vertical sliding block 24 downwardly such that the tip of the horizontal sliding pin 16 protrudes outside the horizontal slot opening 18 for a locking action with the inner tube 12 through aperture 18. To unlock the inner tube 12 from an outer tube (not shown), the cable 28 is pulled up to cause the upward movement of the vertical sliding block 24 and the retraction of the horizontal sliding pin 16 back into the horizontal slot opening 18 thus disengaging the inner tube from the outer tube.

The locking mechanism 10 while effective in performing its function, requires excessive effort in the assembly of the mechanism. Furthermore, a special tool must be used to mount the horizontal sliding pin onto the vertical sliding block. The assembling process is time consuming and not suitable for a mass production operation.

It is therefore an object of the present invention to provide a locking mechanism for use in a pull-handle assembly that does not have the drawbacks or shortcomings of conventional locking mechanisms.

It is another object of the present invention to provide a locking mechanism for a pull-handle assembly that can be easily assembled by hand without the use of special tools.

It is a further object of the present invention to provide a locking mechanism for a retractable pull-handle system by utilizing a vertical sliding member and a horizontal sliding member for converting a vertical motion to a horizontal motion.

It is another further object of the present invention to provide a locking mechanism for a retractable pull-handle system which utilizes a vertical sliding member equipped with inclined surfaces for engaging similarly inclined surfaces on a horizontal sliding member such that a locking pin can be engaged or disengaged between an inner tube and an outer tube.

SUMMARY OF THE INVENTION

In accordance with the present invention, a locking mechanism for a retractable pull-handle system that utilizes a vertical sliding block and a horizontal sliding block for transforming a vertical motion of a pull cable to a horizontal motion of a locking pin is provided.

In a preferred embodiment, a retractable pull-handle system is provided which includes a pair of parallelly positioned and spaced apart support tubes, each of the support tubes includes an open upper end and an interior cavity adapted for accepting an inner tube to slide freely therein when the inner tube is not locked to the support tube, a pull-handle connected to the upper ends of the pair of inner tubes, a locking means including an aperture provided in the support tube for accepting a locking pin, and a locking device fixedly positioned in each of the inner tubes which includes a housing member that has an open front and a vertical slot, the vertical slot is equipped with an open top and a horizontal slot near its center, a vertical sliding member for sliding in the vertical slot, a center portion of the vertical sliding member is equipped with inclined surfaces adapted for engaging a horizontal sliding member, and a horizontal sliding member for sliding in the horizontal slot which is equipped with a locking pin on a surface facing the open front of the housing member and an open slot which has inclined surfaces for engaging the inclined surfaces on the vertical sliding member such that a vertical motion of the vertical sliding block may be transformed into a horizontal motion of the horizontal sliding block for penetrating or retracting the locking pin into or from the aperture in the support tube and thus locking or unlocking the pull-handle system.

The housing member of the locking device further includes a face plate for sealing the opening front and for allowing the locking pin on the horizontal sliding member to penetrate through an aperture provided in the face plate, the locking means may further include a spring means positioned between a bottom surface of the vertical sliding member and a bottom surface of the vertical slot. The spring means is in a relaxed position when the locking means is engaged in locking the inner tube to the support tube. The spring means may be in an extended position when the locking means is disengaged and unlocks the inner tube from the support tube. The spring means may be in a compressed position when the locking means is disengaged and unlocks the inner tube from the support tube. The spring means may be either extended or compressed for disengaging the locking means and for unlocking the inner and support tubes.

In another preferred embodiment, a locking means for locking an inner tube to an outer tube is provided which includes an aperture in the outer tube adapted for receiving a locking pin, and a locking device which is fixedly positioned in the inner tube includes a lock housing equipped with an open front, an open top, a vertical slot and a horizontal slot intersecting the vertical slot, a vertical sliding member for sliding in the vertical slot and for engaging a horizontal sliding member by inclined surfaces provided on the vertical sliding member, a horizontal sliding member for sliding in the horizontal slot and for engaging the vertical sliding member by inclined surfaces provided on the horizontal sliding member, and a locking pin provided on a surface of the horizontal sliding member facing the open front of the lock housing for engaging the aperture in the outer tube, whereby a vertical motion of the vertical sliding block is transformed into a horizontal motion of the horizontal sliding block such that the locking pin is pushed forward or retracted backward from the aperture in the outer tube.

The locking means may further include a face plate for sealing the lock housing with the vertical sliding member and the horizontal sliding member installed therein. The locking means may further include a spring means positioned between a bottom surface of the vertical sliding member and a bottom surface of the vertical slot. The spring means may be in a relaxed position when the locking pin is engaged in locking the inner tube to the outer tube. The spring means may be in an extended position when the locking pin is disengaged and unlocks the inner tube from the outer tube. The spring means may further be in a compressed position when the locking pin is engaged and unlocks the inner tube from the support tube. The spring means may function in either a compressed or an extended state for activating the locking means such that the inner tube is unlocked from the outer tube.

BRIEF DESCRIPTION OF THE DRAWINGS

The invention can be more fully understood by reading the following detailed description of the preferred embodiments, with reference made to the accompanying drawings, wherein.

DETAILED DESCRIPTION OF THE PREFERRED AND ALTERNATE EMBODIMENTS

The present invention discloses a locking means for locking an inner tube to an outer tube utilizing a vertical sliding block and a horizontal sliding block such that a vertical motion of the vertical sliding block can be transformed into a horizontal motion of a locking pin integral with the horizontal sliding block to lock or unlock the two tubes together. The present invention is further directed to a retractable pull-handle system that contains such a lock mechanism.

Figure 1:
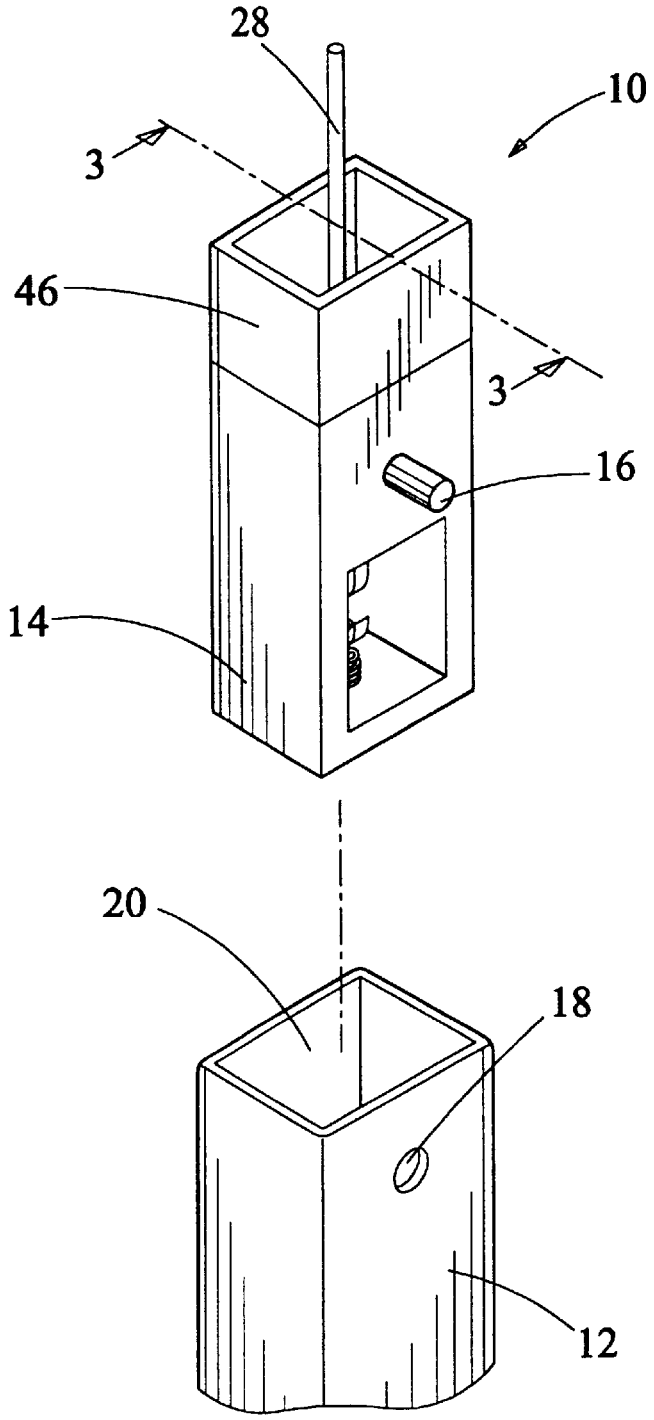
FIG. 1 (PRIOR ART)
FIG. 1 is a perspective view of a conventional locking mechanism for a retractable pull-handle system.
Figure 2:
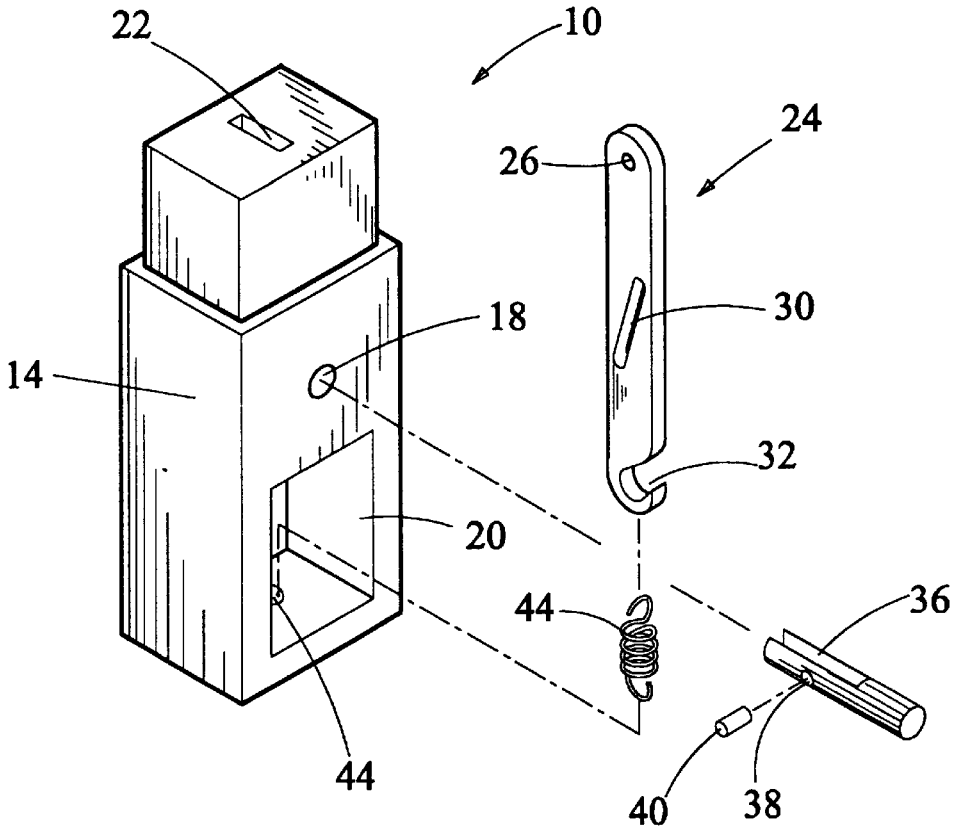
FIG. 2 (PRIOR ART)
FIG. 2 is a perspective view of the components of the locking mechanism of FIG. 1.
Figure 3:
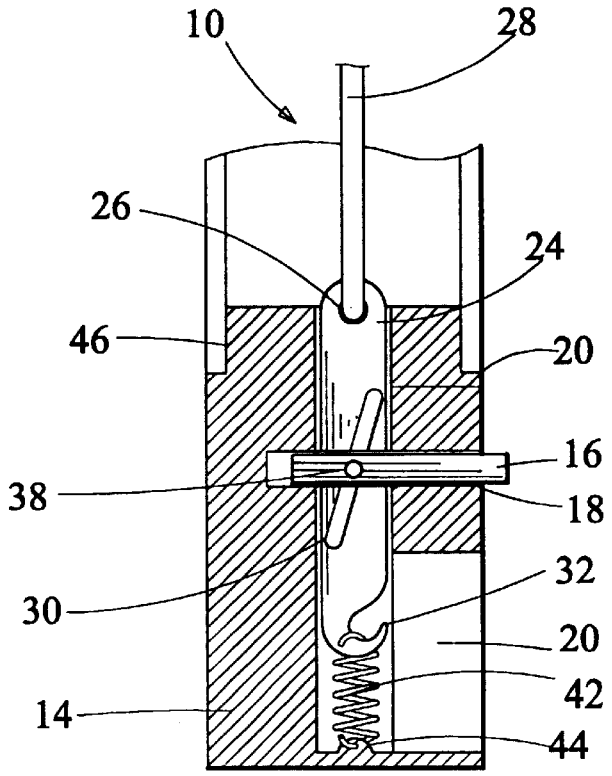
FIG. 3 (PRIOR ART)
FIG. 3 is a cross-sectional view of the locking mechanism of FIG. 1.
Figure 4:
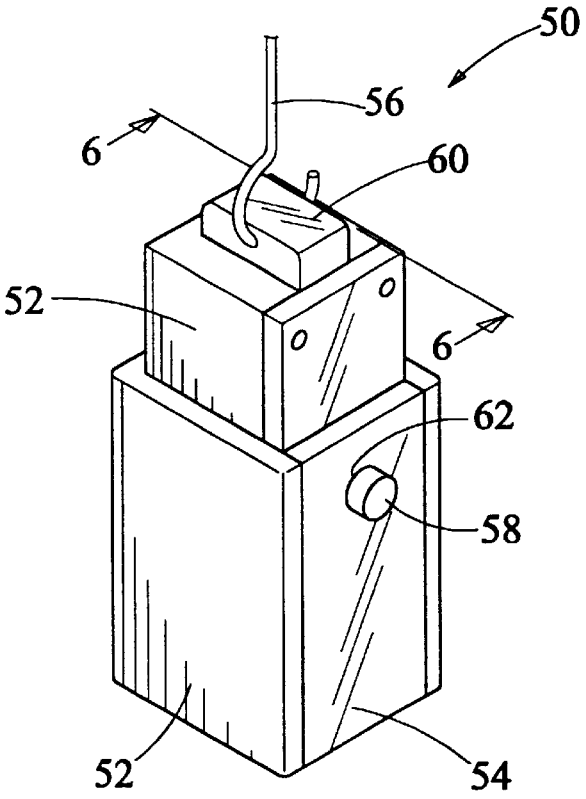
FIG. 4 is a perspective view of the present invention locking mechanism in an assembled state.
Figure 6:
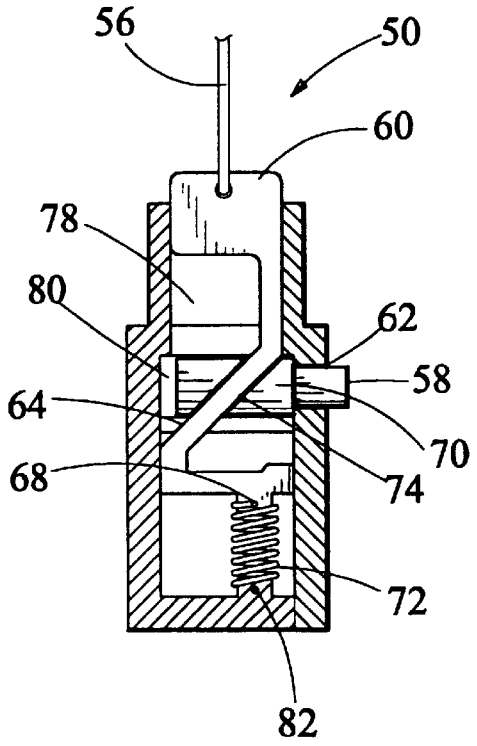
FIG. 6 is a cross-sectional view of the present invention preferred embodiment locking mechanism of FIG. 4.
Figure 5:
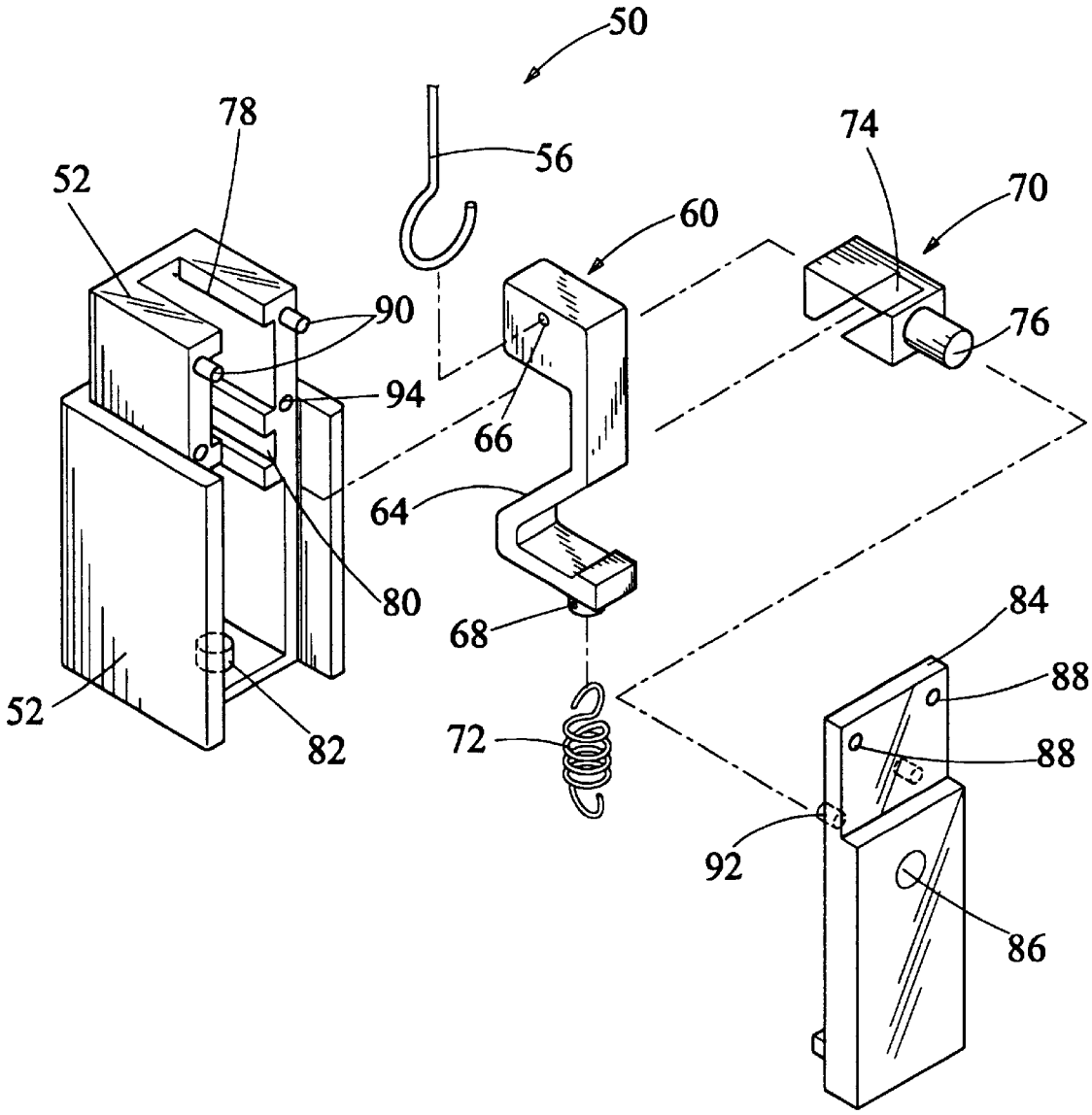
FIG. 5 is a perspective view of the components in the present invention preferred embodiment locking mechanism.

Referring initially to FIG. 4, wherein a present invention preferred embodiment locking mechanism 50 is shown in a perspective view. The locking mechanism 50, with its components shown in a perspective view in FIG. 5 and its cross-sectional view shown in FIG. 6, is constructed by a housing member 52, a face plate 54, a vertical sliding block 60, a pull cable 56 and a locking pin 58 protruding from an aperture 62 provided in the face plate 54. In the preferred embodiment, the key elements of the present invention lock mechanism are the vertical sliding member 60 and the horizontal sliding member 70. It should be noted that the vertical sliding member 60 is constructed, as shown in FIG. 5, in a generally Z-shape which has a slanted rib section 64 at or near the center portion of the block 60. The angle of the slanted rib 64 may be suitably selected such that a vertical motion of the vertical sliding block 60 can be advantageously transformed into horizontal motion of the horizontal sliding block 70 when the two blocks are intimately joined together (as shown in FIG. 6). The vertical sliding block 60 is provided with an aperture 66 at near the top of the block and an aperture 68 at near the bottom of the block. The aperture 66 is used for connecting to a pull cable 56 for activating the locking mechanism, while the bottom aperture 68 is used for connecting to an upper end of spring 72 for returning the vertical sliding block to an unactivated position.

In the horizontal sliding block 70, a slanted slot opening 74 is provided which has the same slant angle and thickness as in the vertical sliding block 60 so that the slot opening 74 intimately engages the rib section 64 when the two blocks are mated inside the lock housing 52. A locking pin 76 is provided on and integral with the front surface of the horizontal sliding block 70 for performing locking or unlocking function of the lock mechanism 50.

In the lock housing 52, a vertical slot opening 78 is provided which extends from the top to the bottom of the lock housing. At or near the center portion of the lock housing 52, a horizontal slot 80 is further provided for mounting the horizontal sliding block 70 such that it moves in the horizontal direction. On the bottom plate of the lock housing 52, a mounting boss 82 is provided such that the bottom end of spring 72 may be attached thereto.

The lock housing 52 may be covered by a face plate 84 which has an aperture 86 therethrough for receiving the lock pin 76 on the horizontal sliding block 70. The face plate 84 further includes two mounting or locating holes 88 for receiving locating pins 90, and locating pins 92 for receiving by locating holes 94.

The advantages provided by the present invention novel locking mechanism for use in a retractable pull-handle system is self evident by a close examination of FIGS. 4~6. The component shown in FIG. 5 can be easily assembled by hand without special tools. For instance, the vertical sliding block 60 can be first assembled to the horizontal sliding block 70 by matching the slot opening 74 with the slanted rib section 64. The upper end of the spring 72 is then attached to the mounting hole 68 and the vertical sliding block/horizontal sliding block assembly can be slid into the vertical slot opening 78 and the horizontal slot opening 80 with minimal effort. The lower end of the spring 72 is then attached to the mounting hole 82 at the bottom of the block housing 52. After the face plate 84 is assembled onto the lock housing 52 by frictionally engaging the locating pins and the locating holes with the locking pins 76 protruding through the aperture 86, the pull cable 56 can be hooked up to the upper aperture 66 in the vertical sliding block 60. The assembling process for the present invention locking mechanism shown in the preferred embodiment can therefore be easily accomplished with minimal effort and without special hand tools.

Figure 7:
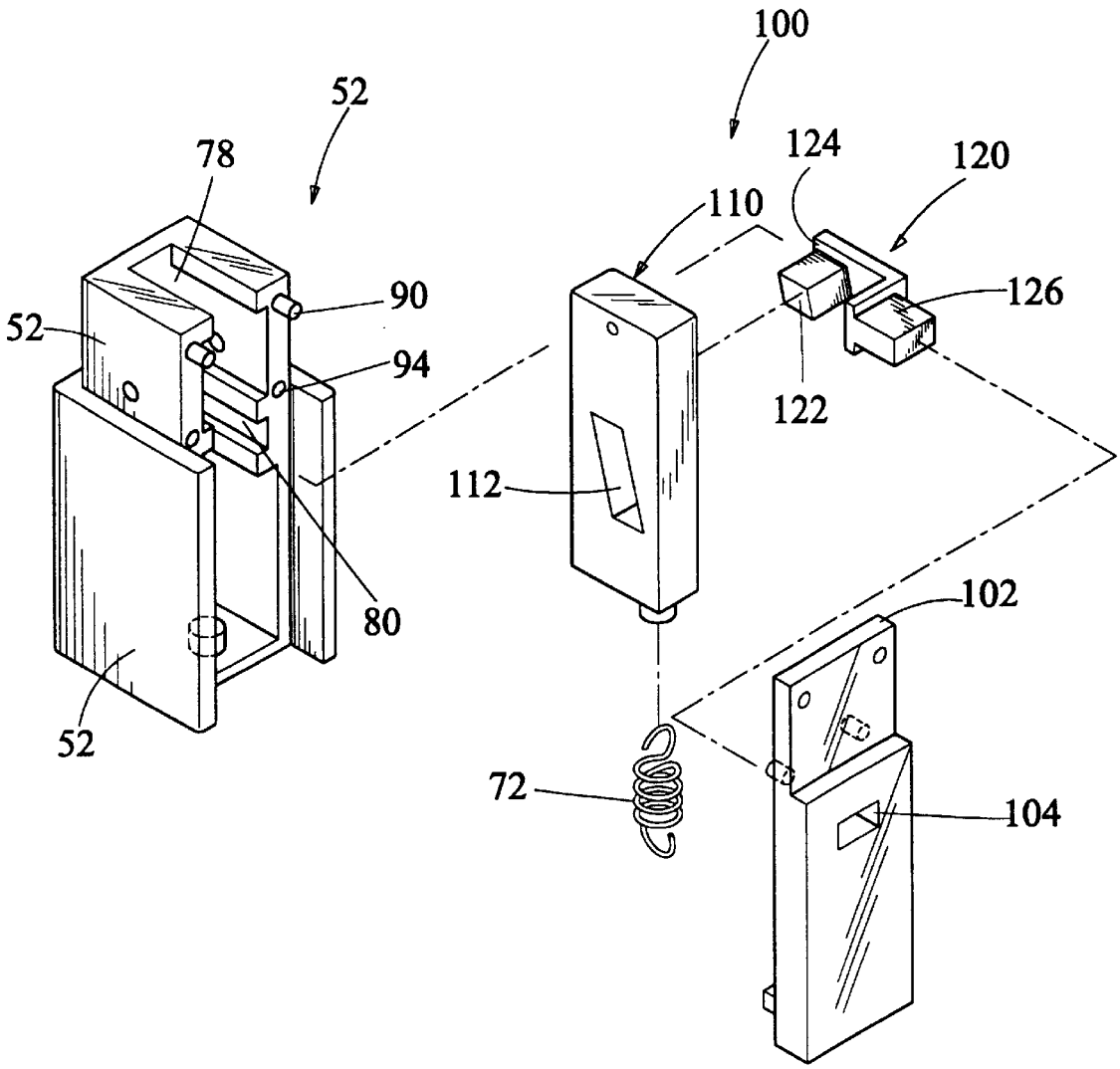
FIG. 7 is a perspective view of the components in a present invention alternate embodiment locking mechanism.

An alternate embodiment of the present invention locking mechanism 100 is shown in FIG. 7. The locking mechanism 100 consists of a lock housing 52 similar in construction with the lock housing in the preferred embodiment, and a face plate 102 which is similar in construction with that in the preferred embodiment except that the aperture 104 is provided in a square shape. The major deviation of the alternate embodiment from the preferred embodiment is the construction of the vertical sliding block 110 and the horizontal sliding block 120. As shown in FIG. 7, the vertical sliding block 110, instead of being shaped in a Z-shape, is in a rectangular shape with a slanted slot opening 112 provided at or near the center of the block 110. The shape and size of the slanted slot opening 112 is the same as that of the rectangular protrusion 122 provided on the face to 124 of the horizontal sliding block 120. The angle of the slant determines the transformation of a vertical motion of the block 110 to the horizontal motion of the block 120. The locking pin 126 protrudes through the square aperture 104 in the face plate 102. The principal of operation of the alternate embodiment shown in FIG. 7 is essentially the same as that for the preferred embodiment.

Figure 8:
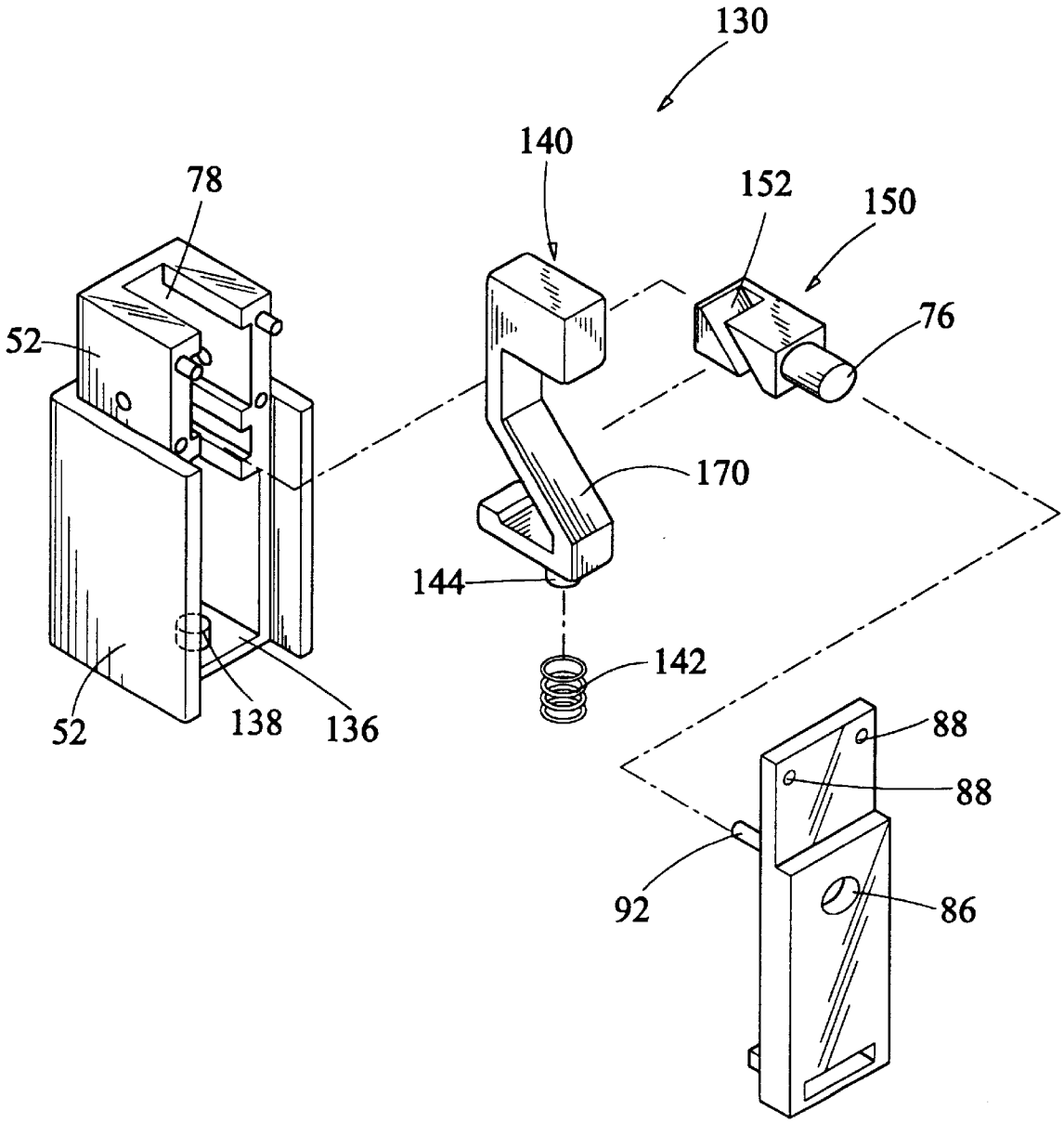
FIG. 8 is a perspective view of the components of a present invention second alternate embodiment locking mechanism.
Figure 9:
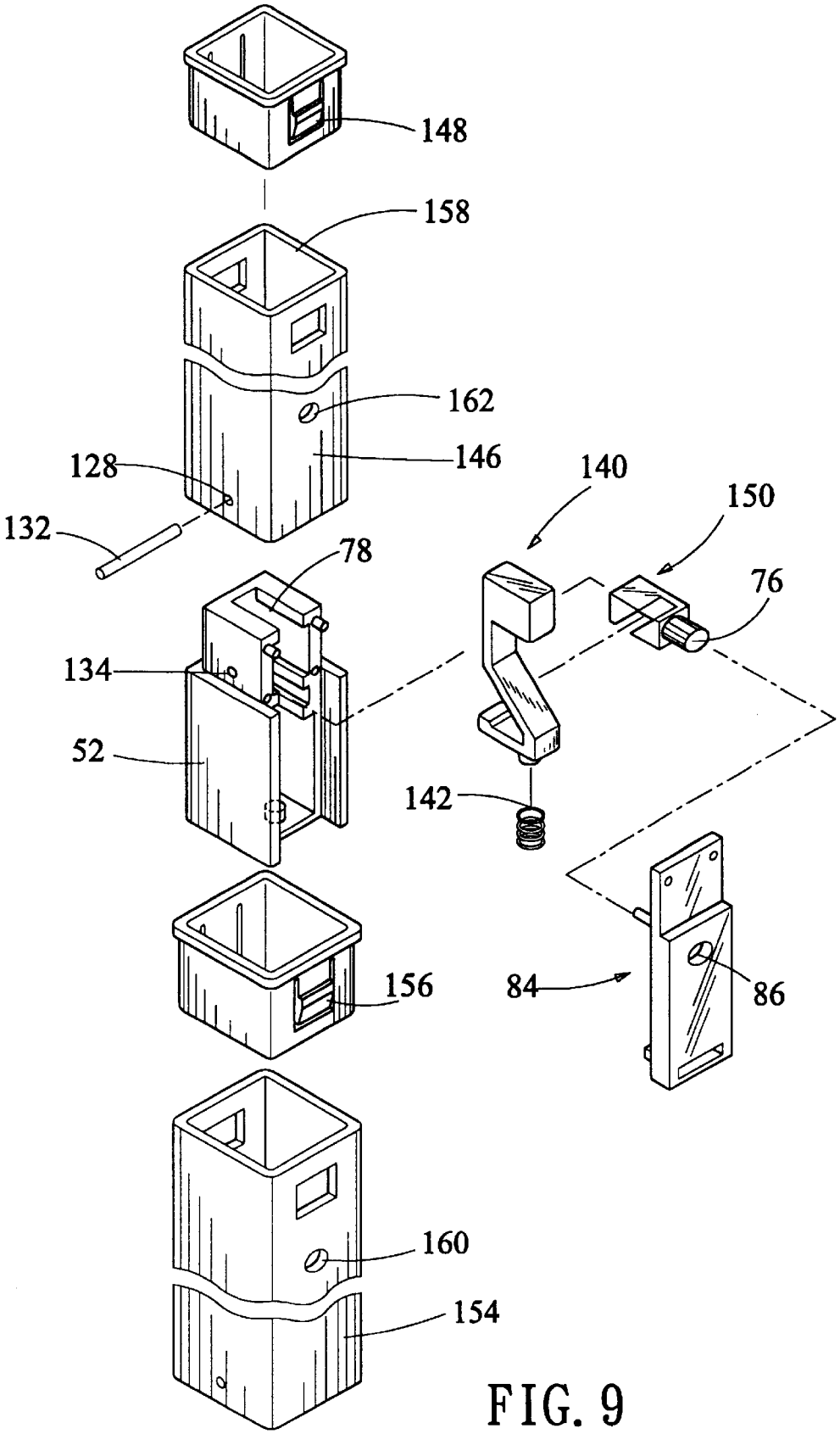
FIG. 9 is a perspective view of the components of the second alternate embodiment of FIG. 8 and an inner tube/support tube assembly.

A second alternate embodiment of the present invention novel locking mechanism 130 is shown in FIG. 8. In this second alternate embodiment, the locking housing 52 and the face plate 84 are essentially the same as that used in the preferred embodiment shown in FIG. 5. The vertical sliding block 140 is a mirror image in construction with that shown in the preferred embodiment, i.e., also in a Z-shape. The horizontal sliding block 150 is also similar with the exception that the slot opening 152 is slanted in an opposite direction to that shown in FIG. 5. Instead of an extensible spring 72 as shown in FIG. 5, a compressible spring 142 is utilized in this second alternate embodiment. The spring 142 is held in place by the boss 144 under the vertical sliding block 140 and the boss 138 located on the bottom plate 136 of the lock housing 52. A perspective view of the individual components of the second alternate embodiment, together with an inner tube 146, an inner tube cap 148, an outer tube 154 and an outer tube cap 156 are shown. The lock housing 52 is fixedly mounted to the inside cavity 158 of the inner tube 146 through an aperture 134, a mounting pin 132 and a mounting hole 128 through the inner tube 146. The locking pin 76 on the horizontal sliding block 150 protrudes into the aperture 162 in the inner tube 146 and the aperture 160 in the outer tube 154. These components are shown in FIG. 9.

Figure 10A:
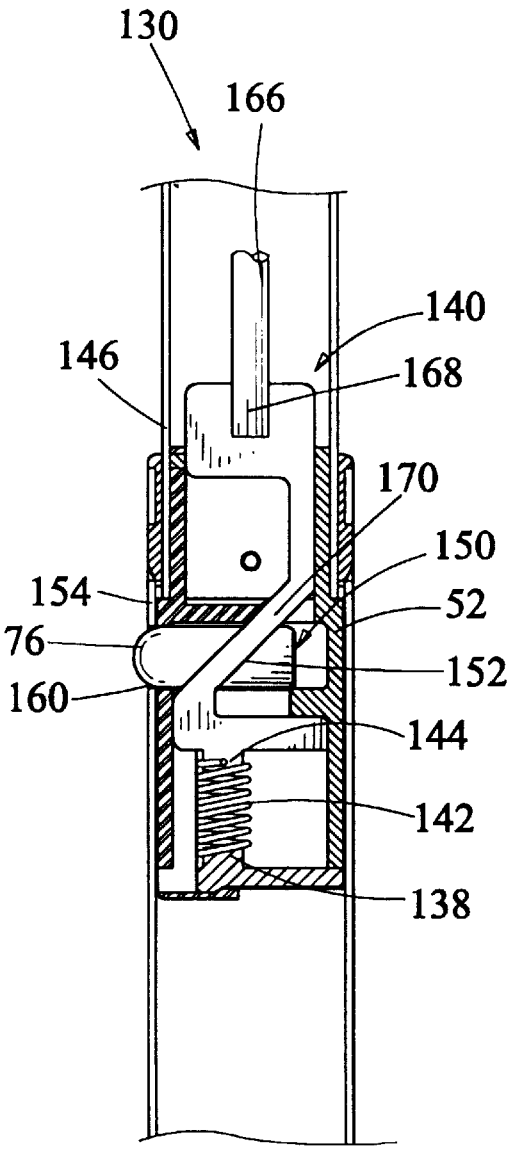
FIGS. 10A and 10B are cross-sectional views of the present invention second alternate embodiment locking mechanism showing a locked and an unlocked position, respectively.
Figure 10B:
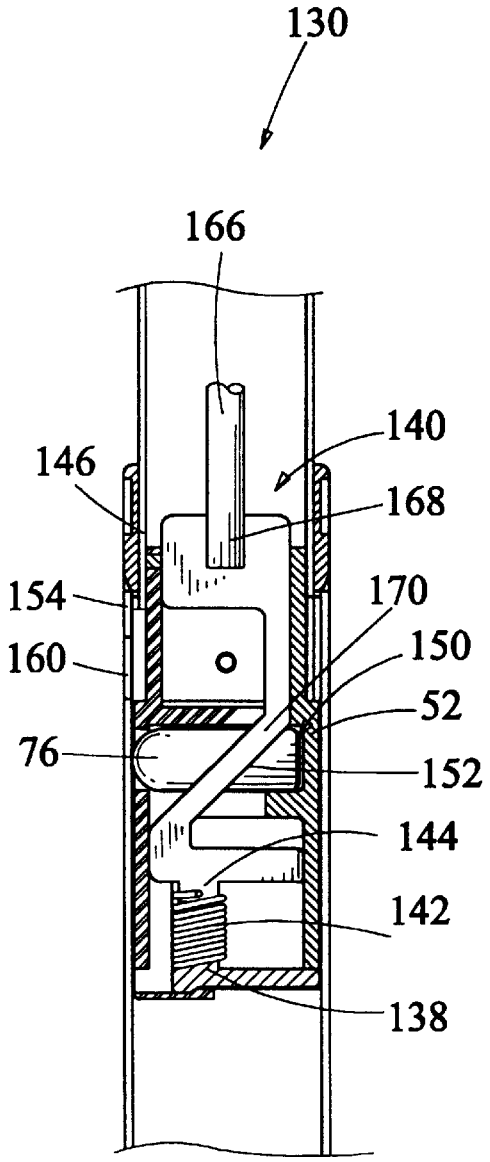

Cross-sectional views of the second alternate embodiment shown in FIG. 8 are shown in FIGS. 10A and 10B in a locked and an unlocked position, respectively. It is seen in FIG. 10A, instead of using a hook as shown in the preferred embodiment, a push rod 166 is used in the second alternate embodiment of the present invention locking mechanism. The push rod 166 rides over the vertical sliding block 140 at the end section 168 of the push rod. The operation of the second alternate embodiment of the present invention vertical and horizontal sliding blocks are therefore different than the operation of the preferred embodiment sliding blocks in relation to the spring 142. The spring 142 is a compressible spring, instead of the extensible spring 72 utilized in the preferred embodiment. When the spring is in a relaxed position, i.e., in an extended position as shown in FIG. 10A, the locking pin 76 protrudes through apertures 86, 162 and 160 and performs the locking function between the inner tube 146 and the outer tube (or the support tube) 154. When a pressure is applied to the push rod 166 and therefore depresses the compressible spring 142, the vertical sliding block 140 is pushed downwardly such that the slanted rib portion 170 on the vertical sliding block 140 engages the slanted slot opening 152 in the horizontal sliding block 150 so that a vertical motion of the vertical sliding block causes a horizontal motion of the horizontal sliding block 150 and thus pulling it back into the lock housing 52 and unlocking the outer tube 154 from the inner tube 146.

Figure 11A:
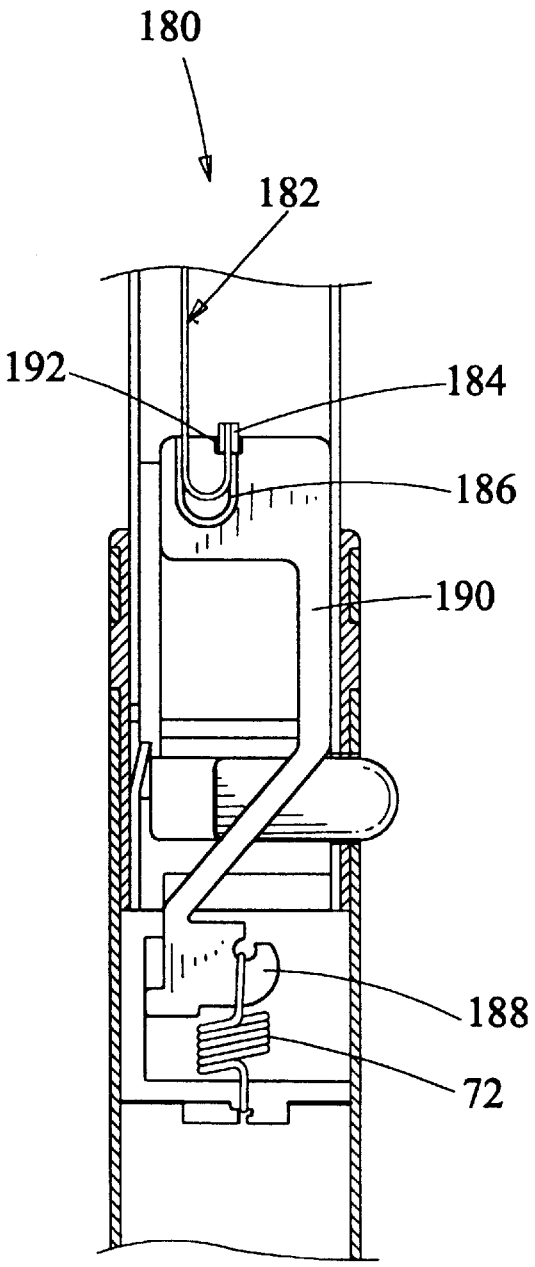
FIGS. 11A and 11B are cross-sectional views of a present invention third alternate embodiment locking mechanism in a locked and an unlocked position, respectively.
Figure 11B:
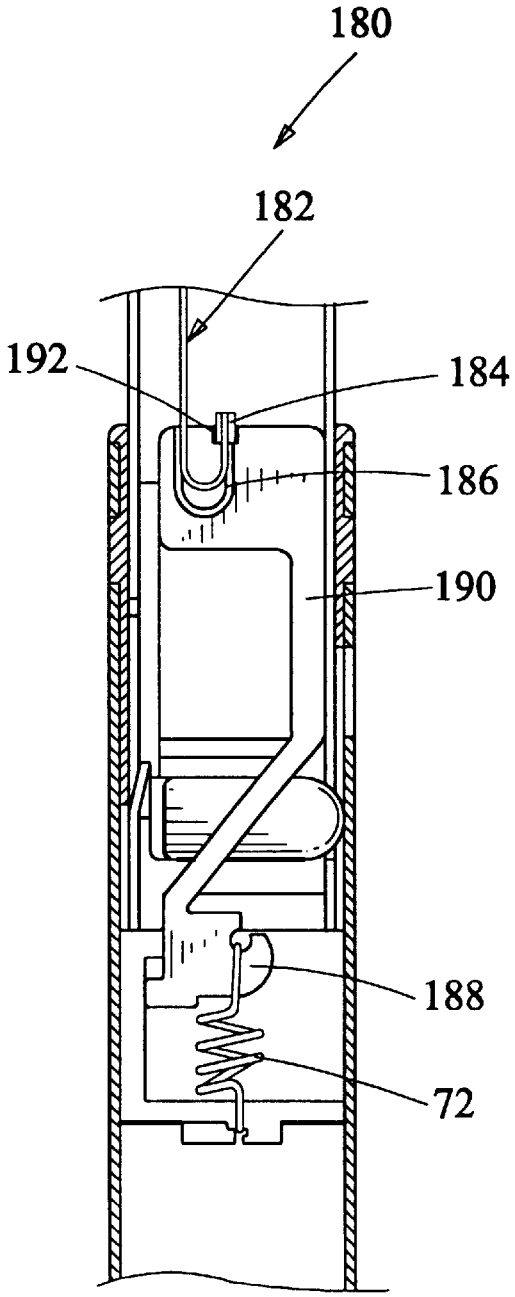

A third alternate embodiment of the present invention lock mechanism is shown in FIGS. 11A and 11B in cross-sectional views in a locked and unlocked position, respectively. The third alternate embodiment locking mechanism 180 is substantially similar to the locking mechanism 50 shown in the preferred embodiment, except that a different pull cable 182 equipped with a pull-out stop 184 and a different lower hook 188 for connecting to the spring 72 are used. The operation of the third alternate embodiment of the locking mechanism is substantially similar to that of the preferred embodiment. Instead of an aperture 66 provided at the top of the Z-shaped vertical sliding member 60, a slot 186 which has a recessed area 192 is provided for connecting the pull cable 182 to the vertical sliding block 190.

The present invention novel locking mechanism for a retractable pull-handle system has been amply illustrated in the above descriptions and in the appended drawings of FIGS. 4~11 in a preferred and three alternate embodiments. It should be noted that other possible variations can be derived from the present invention novel vertical sliding block and horizontal sliding block combination while achieving simultaneously the same desirable results.

While the present invention has been described in an illustrative manner, it should be understood that the terminology used is intended to be in a nature of words of description rather than of limitation.

Furthermore, while the present invention has been described in terms of a preferred and three alternate embodiments, it is to be appreciated that those skilled in the art will readily apply these teachings to other possible variations of the inventions.

The embodiment of the invention in which an exclusive property or privilege is claimed are defined as follows:

1. A retractable pull-handle system comprising:

a pair of inner tubes, a pair of parallely positioned and spaced-apart support tubes, each of said support tubes comprises an open upper end and an interior cavity adapted for accepting an inner tube to slide freely therein when said inner tube is not locked to said support tube, a pull handle connected to upper ends of said pair of inner tubes, and a locking means comprises:

an aperture provided in said support tube for receiving a locking pin, and a locking mechanism fixedly positioned in each of said inner tubes comprising a housing member having an open front and a vertical slot, said vertical slot being equipped with an open top and a horizontal slot near its center; a vertical sliding member for sliding in said vertical slot, a center portion of said vertical sliding member being equipped with a slanted rib section adapted for engaging a horizontal sliding member; and the horizontal sliding member for sliding in said horizontal slot equipped with a locking pin on a surface facing said open front of the housing member and a slanted slot having inclined surfaces for intimately engaging said slanted rib section on said vertical sliding member such that a vertical motion of said vertical sliding block is transformed into a horizontal motion of said horizontal sliding block for penetrating or retracting said locking pin into or from said aperture situated in said support tube and thus locking or unlocking said pull-handle system.

2. A retractable pull-handle system according to claim 1, wherein said housing member of said locking mechanism further comprises a face plate for sealing said open front and for allowing said locking pin on said horizontal sliding member to penetrate through an aperture provided in said face plate.

3. A retractable pull-handle system according to claim 1 further comprising a spring means positioned between a bottom surface of said vertical sliding member and a bottom surface of said vertical slot.

4. A retractable pull-handle system according to claim 3, wherein said spring means is in a relaxed position when said locking means is engaged in locking said inner tube to said support tube.

5. A retractable pull-handle system according to claim 3, wherein said spring means is in an extended position when said locking means is disengaged and unlocks said inner tube from said support tube.

6. A retractable pull-handle system according to claim 3, wherein said spring means is in a compressed position when said locking means is disengaged and unlocks said inner tube from said support tube.

7. A retractable pull-handle system according to claim 3, wherein said spring means may be either extended or compressed for disengaging said locking means and for unlocking said inner and support tubes.

8. A locking means for locking an inner tube to an outer tube comprising:

an inner tube and an outer tube, an aperture in said outer tube adapted for receiving a locking pin, and a locking device fixedly positioned in said inner tube comprising:

a lock housing equipped with an open front, an open top, a vertical slot and a horizontal slot intersecting said vertical slot, a vertical sliding member for sliding in said vertical slot and for engaging a horizontal sliding member by a slanted slot opening defined by a trapezoid having two parallel inclined surfaces provided on said vertical sliding member, a horizontal sliding member for sliding in said horizontal slot and having inclined surfaces corresponding to and intimately engaging the inclined surfaces of the slanted slot opening, and a locking pin provided on a surface of said horizontal sliding member facing said open front of the lock housing for engaging said aperture in the outer tube, whereby a vertical motion of said vertical sliding block is transformed into a horizontal motion of said horizontal sliding block such that said locking pin is pushed forward or retracted backward from said aperture in said outer tube.

9. A locking means for locking an inner tube to an outer tube according to claim 8 further comprising a face plate for sealing said lock housing with said vertical sliding member and said horizontal sliding member mounted therein.

10. A locking means for locking an inner tube to an outer tube according to claim 8 further comprising a spring means positioned between a bottom surface of said vertical sliding member and a bottom surface of said vertical slot.

11. A locking means for locking an inner tube to an outer tube according to claim 10, wherein said spring means may be either extended or compressed for disengaging said locking means and for unlocking said inner and outer tubes.

12. A locking means for locking an inner tube to an outer tube according to claim 10, wherein said spring means is in a relaxed position when said locking means is engaged in locking said inner tube to said outer tube.

13. A locking means for locking an inner tube to an outer tube according to claim 10, wherein, said spring means is in an extended position when said locking means is disengaged and unlocks said inner tube from said outer tube.

14. A locking means for locking an inner tube to an outer tube according to claim 10, wherein said spring means is in a compressed position when said locking means is disengaged and unlocks said inner tube from said outer tube.

* * * * *